United States Patent [19]

Rolin

[11] Patent Number: 4,566,148

[45] Date of Patent: Jan. 28, 1986

[54] DEVICE FOR SCRAPING OFF LIQUID

[76] Inventor: Oskar L. Rolin, 45, Chartwell Ct., Brighton, Sussex BN1 2EX, England

[21] Appl. No.: 554,022

[22] Filed: Nov. 21, 1983

[30] Foreign Application Priority Data

Nov. 26, 1982 [SE] Sweden ..... 8206765

[51] Int. Cl.[4] ..... B05C 21/00

[52] U.S. Cl. ..... 15/257.05; 15/257.06

[58] Field of Search ..... 15/257.05, 257.06; 220/90, 22, 22.1

[56] References Cited

U.S. PATENT DOCUMENTS

| | | | |
|---|---|---|---|
| 557,014 | 3/1896 | Osgood | 15/257.05 X |
| 1,065,823 | 6/1913 | Matthews | 15/257.05 X |
| 2,939,162 | 6/1960 | Kravitt | 15/257.05 |
| 4,020,523 | 5/1977 | Brown | 15/257.05 |

FOREIGN PATENT DOCUMENTS

| | | | |
|---|---|---|---|
| 157320 | 12/1904 | Fed. Rep. of Germany | 15/257.05 |
| 2140189 | 2/1973 | Fed. Rep. of Germany . | |
| 2332676 | 12/1974 | Fed. Rep. of Germany . | |
| 1113574 | 3/1956 | France . | |
| 86689 | 10/1955 | Norway . | |

*Primary Examiner*—Edward L. Roberts

*Attorney, Agent, or Firm*—Pollock, Vande Sande & Priddy

[57] ABSTRACT

A scraper device intended for scraping off and/or evening-out a liquid, e.g. paint in a container, is buoyantly disposed in the liquid. The device has a scraping surface (12) which is grid-like and has side walls (36, 37) bearing against the walls of the container. The grid configuration can be formed by U-shaped strips (11) with the opening facing downwards in the liquid. The ends of the strips are connected to each other by the side walls which suitably are doubled so that the scraper device obtains a buoyancy adapted to the viscosity of the liquid.

9 Claims, 7 Drawing Figures

DEVICE FOR SCRAPING OFF LIQUID

TECHNICAL FIELD

Figure 1:
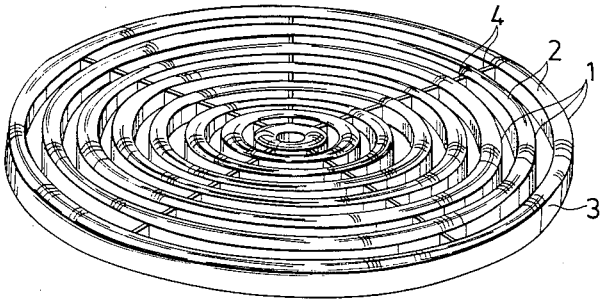

The present invention relates to a device for scraping off and/or evening-out a liquid applied to a tool such as a brush, roller or the like when this is lowered into a container holding the liquid, such that the tool, on removal from the container, is disposed for coming against a scraper arranged floating inwards of the side of the container.

BACKGROUND ART

Special troughs have come into increasing use to avoid dropping and spilling when applying liquids, such as paints, varnishes, oils and the like, on different objects with tools such as brushes, rollers and the like. Thereby one has been forced to fill the trough with liquid from the original container. This development has been particularly noticeable in painting work, and accordingly the continued description will deal primarily with painting and particularly painting rollers. However, it is obvious that the same problem and conditions apply for other liquids and tools.

In painting walls and ceilings with rollers a special trough is normally used, in which the paint has been poured so that it can be taken up by the roller. The trough is formed with a paint removal side portion intended to assist in the removal of excess paint. It is also known for professional painters to dip the roller directly into the original can of paint and to remove the excess paint from the roller by rolling it a few times against a sheet of masonite. These known methods result in waste of paint and time.

From the patent literature, e.g. the German Patent No. 2 140 189, it is also known to utilize a special, completely flat slab-like insert which has been placed buoyantly on the surface of the paint in the container in which the paint is kept during painting. The technical function of the known device can be questioned, however, since it tips over easily and has a tendency to bind against the walls of the container. Other disadvantages with the known device are that due to the holes or slits in the insert it presses up paint, which, when a roller is to be given more paint, will be pressed in front of the roller as a kind of bow wave and thereby inhibit uniform take-up of paint. The roller will thus take up excess paint in patches, and particularly at its short ends. This paint cannot be scraped off but forms drops during painting.

DISCLOSURE OF INVENTION

In order to surmount the disadvantages in the known devices and to achieve a functionally satisfactory paint scraper the paint scraper in accordance with the present invention has been formed with a grid-like scraping-off surface, which is open to the liquid surface, and with a buoyancy capacity adjusted to keeping the scraping-off surface level with that of the liquid.

With this scraper the tool, e.g. one of the roller type, is prevented from being dipped too deeply into the liquid, while the requirement of good liquid distribution along the whole of the roller surface is met at the same time. Furthermore, liquid (paint) coming up on the short ends of the roller is avoided. These advantages are achieved by the floating capacity of the scraper being adjusted to the viscosity of the liquid such that the scraper is kept "semi-boyant" in the liquid with only the scraping-off surface at the same height as the liquid level.

The inventive device thus has a bouyancy such that it accompanies the liquid level in the container in which the scraper is placed. The bouyancy property is obtainable in different ways, e.g. as in one embodiment of the invention, where the scraping-off surface is made up from strips having a U-shaped cross section, the strips being divided up into open U-sections facing towards the liquid to form floating bodies. In this embodiment of the invention the strips can be arranged either in the same plane and parallel to each other in a rectangular configuration or as coaxial rings, depending on the shape of the liquid container in question. At least two mutually opposing sides of the scraper may be provided with side walls arranged to project up above the scraping-off surface. The side walls thus form gliding surfaces against the walls of the container and also constitute indicating means denoting that the container is provided with a scraper.

In a second embodiment of the invention, the bouyancy properties are obtained by the scraper being formed as a flat slab with a recess, this slab having upstanding side edges guiding the device against the walls of the container. The recess includes an angularly placed scraper formed as a grid or strainer, and with its end nearest the liquid surface folded such as to be parallel in plane with the flat slab and liquid surface. This embodiment of the device in accordance with the invention may also have side walls surrounding the grating or strainer and having a depth of height corresponding to the slope and depth of the grid or strainer. These side walls are suitably arranged with a slight slope towards each other.

The apparatus in accordance with the invention can be made stackable by the side walls being placed somewhat outside the scraping-off surface or sloping outwards from the scraping-off surface.

Another advantage with these side walls is that the scraper is given a wide rubbing path against the walls of the container. There is thus avoided the risk that the scraper will tip, or bind against the container walls.

Although any material resistant to the liquid in question is utilizable for the device according to the invention, plastics have been found to be well suited to the purpose. The entire device can thus be implemented as a unit to a minimum manufacturing cost. The inventive scraper device has accordingly been found to suit its purpose so well that every container can be provided with an inventive scraper device after being filled with liquid and before being provided with a lid. The container will thus be supplied with a scraper device, which can remain floating in the liquid the whole time, and can be disposed of together with the container when the liquid has been used.

In painting, for example, the painter (professional as well as amateur) may thus utilize the original container for the paint and take the roller directly from it to the wall or ceiling surface which is to be painted, without the paint dropping from the roller. The device will thus save time and give rise to less of paint waste when the roller is taken from the container to the painting location.

Another substantial advantage with the inventive device is that paint will be more evenly applied to the roller and the roller can be caused to take up a greater amount of paint than what has been possible up till now.

This means in turn that the surface which can be painted after each application of paint to the roller is increased.

PREFERRED EMBODIMENTS

The invention will now be described in detail below with reference to the accompanying drawings, which illustrate different embodiments of the device for scraping off and/or evening-out liquid on a tool. The device is here described in conjunction with painting using a roller, but the invention can just as well be used for liquids other than paints and for tools other than rollers. On the appended drawings there are illustrated in FIGS. 1 and 2 a first embodiment of the device in accordance with the invention, intended for containers having a circular cross section, FIGS. 3 and 4 a second embodiment of the inventive device, intended for containers having a rectangular cross section, FIGS. 5 and 6 a modified, particularly preferred embodiment of the inventive device according to FIGS. 3 and 4, and in FIG. 7 a further embodiment of the inventive device, intended for containers with circular cross section.

Figure 2:
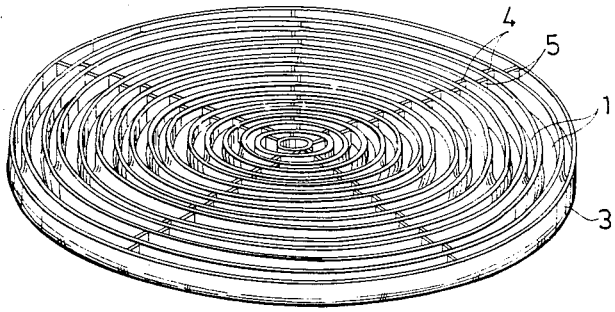

The first embodiment of the inventive device illustrated in FIGS. 1 and 2 is intended for containers with a round cross section. The device is illustrated in FIG. 1 as seen when it floats in the paint in a container, while FIG. 2 illustrates the same device seen from below.

The device according to FIGS. 1 and 2 consists of a scraper formed by a plurality of mutually coaxial strips 1. Each strip is annular and has a U-shaped cross section, thus providing a ridge-like surface 2 for scraping off and evening-out paint. The outer side 3 of the outmost strip 1 is intended as a rim to bear against the wall of the container (not shown), while the scraper floats in the surface layer of the liquid in the container. The side 3 can be advantageously extended upwards and/or downwards to form a wider band bearing against the wall of the container. By extending side 3 solely in one direction there is also obtained a suitable stackability of the scrapers.

The strips 1 are kept together by bars 4, arranged along five uniformly spaced radii in the illustrated embodiment. The location of the bars 4 may of course be arranged in any desired manner.

The bars 4 may be made of thin material which is easily separable, either by breaking or with some tool. There is thus achieved the advantage that the scraper can be adjusted to containers having different diameters by having one or more strips 1 removed by parting the bars 4 appropriately.

It will be seen from FIG. 2 that the channel-shaped underside of the strip 1 is sub-divided by intermediate walls 5 to different sections which together form a bouyant body. The number and distribution of the intermediate walls 5 may be selected according to desire.

Figure 3:
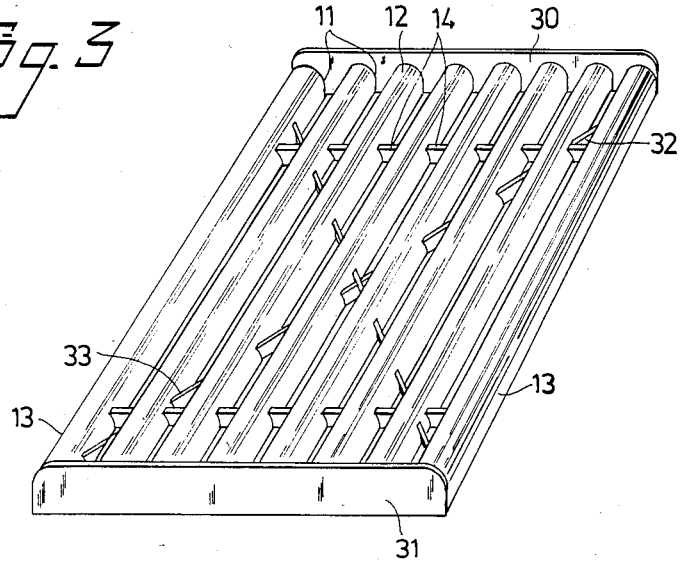
Figure 4:
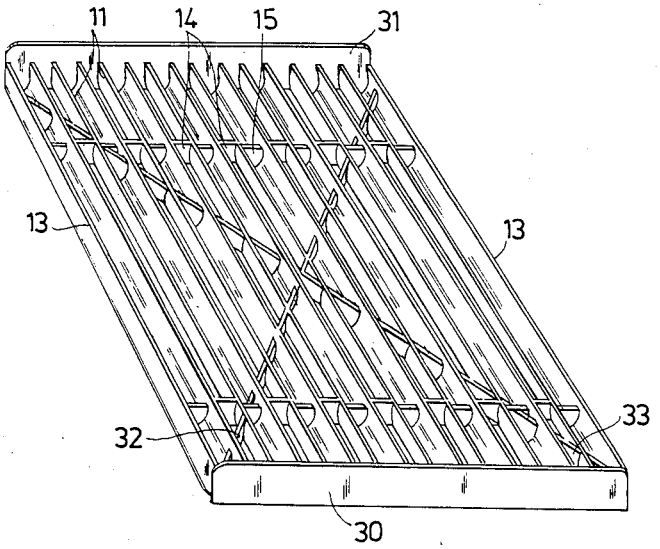

A scraper similar to the one just described in conjunction with FIGS. 1 and 2 is illustrated in FIGS. 3 and 4, and is preferably intended for containers having a rectangular cross-section, the scraping strips in this case being denoted by the numeral 11. FIG. 3 illustrates the scraper seen from the opening of a container (not illustrated) while FIG. 4 illustrates the scraper seen from below. The strips 11 are arranged mutually parallel and in the same plane, and the scraper otherwise has the same implementation as the round scraper described above. The number and placing of the bars 14 and intermediate walls 15 may be selected as desired.

The embodiment of the inventive device illustrated in FIGS. 3 and 4 may, as with the embodiment described in conjunction with FIGS. 1 and 2, be formed with side walls 30, 31. These side walls 30, 31 may have the same design and height as the bars 14 or, as shown, be lengthened upwards (or downwards) to fit well against the container wall (not shown). Since the material in the scraper device is selected such as to have relatively thin dimensions, with a material thickness of about 1 to 0.4 mm, extra reinforcing walls may be needed. Such walls are illustrated in FIGS. 3 and 4 as diagonal bars 32, 33.

By making the embodiment of the scraper device illustrated in FIGS. 3 and 4 with a quadratic shape, and arranging a suitable number of series of bars 14 and intermediate walls 15, this quadratic scraper may also form the basis of a circular embodiment. The intersection point of the diagonal bars 32, 33 is thereby taken as a center and the material outside a radius drawn from this center is clipped away.

Although the strips 1, 11 have been shown to have a U-shaped cross section, they may also be formed in some other way to obtain the necessary buoyancy function. The bars 4, 14 may be provided with score lines for facilitating possible cutting or rupturing, and the ridge-shaped scraping surfaces 2, 12 of the respective strips may be provided with means for improving paint distribution and removal.

Figure 5:
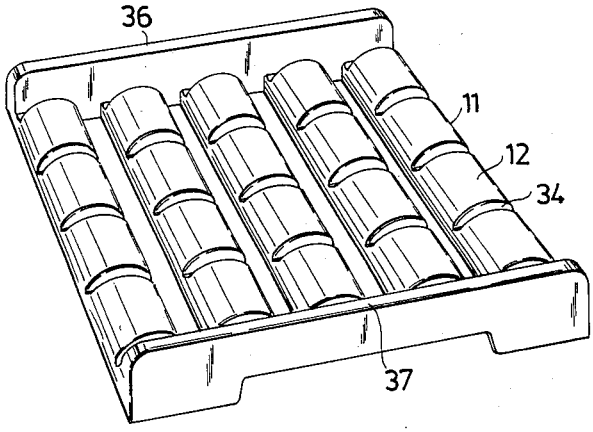
Figure 6:
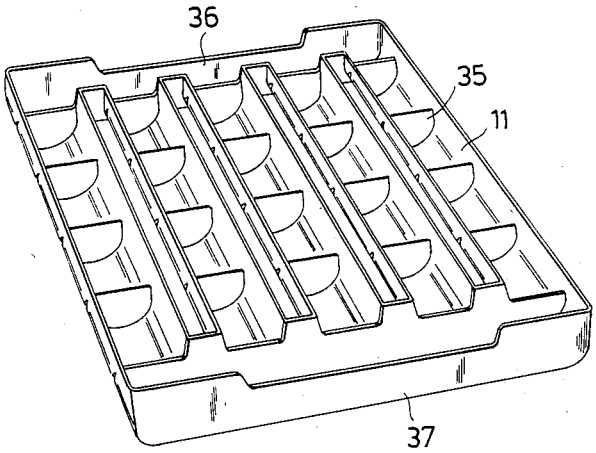

As an example of such a modified embodiment of the scraper according to the invention a particularly preferred design of the scraper is shown in FIGS. 5 and 6. The strips 11 have maintained their U-shaped cross section but the intermediate walls within the strips 11 have been replaced by slit shaped depressions 34 of the material of the ridge-shaped scraping surface 12. The impressed material thus forms arched intermediate walls 35 within the strips 11.

The particularly preferred embodiment of the scraper shows side walls 36, 37 connecting the strips 11 to each other at the ends of the strips 11. Each one of the side walls 36 is doubled and forms a covered space which together with the sections formed by the intermediate walls 35 give the scraper a well suited buoyancy. The doubled side walls 36, 37 have proved to give such a stability to the scraper that the bars (4, 14, 32, 33 according to FIGS. 1–4) are not required. The cross section of the side walls 36, 37 as well as the shape of the rest of the scraper is adapted to make the scraper stackable.

The embodiment shown in FIGS. 5 and 6 is well suited for vacuum and pressure moulding while the embodiments shown in FIGS. 1–4 are more suitably to make by injection moulding.

Figure 7:
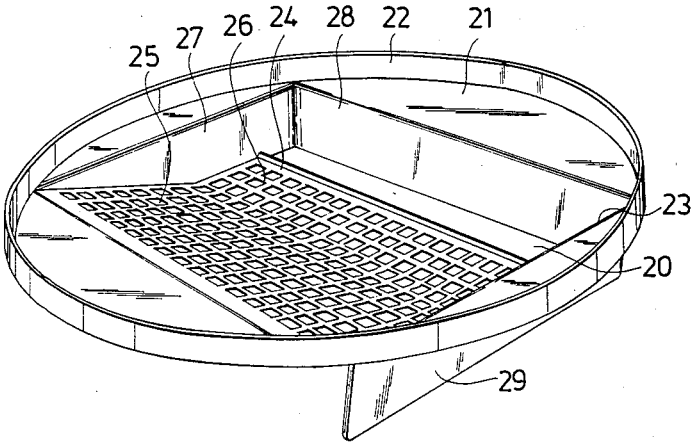

A still further embodiment of the inventive scraper is illustrated in FIG. 7. This includes a flat sheet 21. The sheet 21 has an extension corresponding to the cross section of the container (not shown) in which the paint is delivered, and in which it is kept during painting. In this case the container has been assumed to have a circular cross section, but can naturally have any other cross section, to which the sheet 21 is adjusted.

The sheet 21 is formed with a brim 22 of a predetermined height. The brim 22 is intended to bear against the wall of the container while the sheet 21 floats in the surface layer of the paint (not shown) kept in the container. The brim 22 in the illustrated embodiment is directed away from the surface of the paint, but may naturally be downwardly directed towards the paint surface, or may be situated more or less evenly disposed on either side of the plane of the sheet 21.

A recess 23 is made centrally in the sheet 21. The recess 23 is substantially covered by a grid 24 starting from one edge of the recess 23 where the grid 24 is integral with the flat sheet 21. The grid 24 has a scraping surface 25 forming an angle to the flat sheet 21 and sloping downwards in a direction towards the surface of the paint (not shown). The scraping surface 25 merges into a wetting surface 26 which is parallel in plane with the plane of the sheet 21 and the surface of the paint. The grid 24 is surrounded on at least three sides by side walls 27, 28 and 29 which start from the edges of the recess 23 and are downwardly directed towards the paint surface. To make the device stackable, the side walls 27, 28, 29 should slope towards each other to form a truncated pyramid with the base facing upwards. Furthermore, the lower edge of the side walls 27 and 28 must be formed to accompany the slope of the grid 24.

The grid 24 preferably has an open slot 20 up to the remote wall 28 of the recess 23 for ensuring a good supply of paint when a roller is taken down towards the wetting surface 26. A corresponding open slot may be made at the junction between the flat sheet 21 and the grid 24 for effectively returning the excess paint to the container.

The scraper floats in the paint when in use. The strips 1 (FIG. 1), 11 (FIGS. 3–6) and the side walls 27, 28, 29 (FIG. 7) are thus immersed in the paint. Depending on the adjustment between the bouyancy capability of the scraper and the viscosity of the paint, the roller (not shown) will not need to be placed with any force against the ridge-shaped scraping surface 2 (FIG. 1), 12 FIGS. 3, 5 or the grating 26 (FIG. 7), and the scraper will already be suitably immerged in the liquid for the right amount of paint to be on the scraping surface or grid. The rim 3 (FIG. 1), 13 FIG. 3 or 22 (FIG. 7) bears against the inner wall of the container and facilitates the application of paint to the roller and scraping off against the scraping surfaces 2, 12 or grid 25, 26. A uniform application of paint to the roller takes place simultaneously as excess paint is scraped from the roller for return to the container.

By the inventive scraper having relatively good bouyancy, it is ensured that the roller is not dipped too deeply into the paint, which prevents paint from coming up on the end surfaces of the roller. In previous paint applying aids, such excess of paint on the roller end surfaces has been customary and has been a great problem, since these end surfaces are often formed concave about the shaft on which the roller rotates. The paint taken up here has run and dropped off the roller long after the roller has been taken from the container. With the scraper device in accordance with the invention, the roller normally only needs to be dipped to a small depth in the paint, since the scraper provides a natural counterforce to further emersion of the device.

Although different preferred embodiments have been described above and illustrated on the drawings, the device can be modified in many different ways without departing from the inventive concept. Other embodiments have been indicated in the description hereinbefore, and the present invention is not to be regarded as limited to the preferred embodiments accounted for here.

I claim:

1. A device positioned in a liquid container for scraping liquid from a tool such as a brush, roller or the like, when the tool is dipped into and withdrawn from the container, the device comprising:

a body comprising a plurality of spaced apart co-planar strips arranged in a parallel or coaxial relationship, each strip having a U-shaped cross-section for forming channel-like buoyant bodies subdivided by intermediate walls into different sections, convex surfaces of the U-shaped strips providing a grid-like scraping surface on the upper surface of said body, and the concave surfaces of the U-shaped strips being at least partially immersed in the liquid for maintaining the device buoyant within the liquid so that the scraping surface remains substantially level with the top of the liquid in the container.

2. The device as claimed in claim 1 wherein the peripheral walls of the scraper conform to the cross section of the container for bearing against confronting inner walls of the container and wherein similarly formed device nest together in a stack.

3. The device as claimed in claim 1 wherein the ends of the co-planar strips are connected to the peripheral walls, the latter being double walled for increasing the buoyancy of the device.

4. The device as claimed in claim 3, characterized in that the material of the co-planar strips is depressed to form double walled intermediate recesses which further increase the buoyancy of the device.

5. The device as claimed in claim 3 wherein the co-planar strips are linked by transverse bars formed from thin material having score lines permitting partition of strips to obtain a scraper device adjustable to different container dimensions.

6. A device positioned in a liquid container for scraping liquid from a tool such as a brush, roller or the like when the tool is dipped into and withdrawn from the container, comprising a body having an upper surface with a centrally arranged recess formed therein for receiving a grid-like scraping surface which extends from the upper surface at an angle to the upper surface in a direction downward toward the surface of the liquid stored in the container, the scraping surface being angled at its lower end to form a tool-wetting surface, the plane of which is parallel to the upper surface, and means at the lower surface of said body for contacting the liquid and maintaining the device buoyant within the liquid so that the scraping surface remains substantially level with the top of the liquid in the container.

7. The device as claimed in claim 6 wherein the recess in the upper surface is quadrilateral and has side walls directed downwardly toward the liquid surface, said side walls being disposed on at least three sides of the recess from which the scraping surface does not extend; and further wherein the scraping surface has an elongated slot therein for supplying liquid to the scraping surface.

8. The device as claimed in claim 7 wherein the peripheral wall extends upwardly from the upper surface to form a brim extending in a direction away from the liquid surface.

9. The device as claimed in claim 8 wherein the side walls of the recess are positioned at inclined angles to permit nested stacking of the devices.

* * * * *